United States Patent [19]

Kopelowicz

[11] Patent Number: 4,689,861

[45] Date of Patent: Sep. 1, 1987

[54] ANCHORING DEVICES FOR JOINING OVERLAPPING CLOTHS FOR GARMENTS OR ARTICLES MANUFACTURED WITH THEM

[76] Inventor: Alberto Kopelowicz, 103 Heredia 1165, SanMartin, Buenos Aires 1650, Argentina

[21] Appl. No.: 869,041

[22] Filed: May 30, 1986

[30] Foreign Application Priority Data

Jun. 18, 1985 [AR] Argentina ..... 300739

[51] Int. Cl.[4] ..... A44B 11/25

[52] U.S. Cl. ..... 24/662; 24/663; 24/616

[58] Field of Search ..... 24/663, 662, 588, 616, 24/617, 621, 622, 623, 297, 116 A, 265 WS

[56] References Cited

U.S. PATENT DOCUMENTS

| | | | |
|---|---|---|---|
| 278,346 | 5/1883 | Long | 24/662 |
| 921,846 | 5/1909 | Kerley | 24/616 |
| 1,014,148 | 1/1912 | Heller | 24/662 |
| 1,104,207 | 7/1914 | McCracken | 24/662 |
| 1,347,515 | 7/1920 | Lutz | 24/663 |
| 2,184,650 | 12/1939 | Roseman | 24/663 |
| 3,251,110 | 5/1966 | Hedu | 24/616 |
| 3,967,351 | 7/1976 | Rosenberg et al. | 24/616 |
| 4,506,419 | 3/1985 | Mitomi | 24/297 |

*Primary Examiner*—Victor N. Sakran

[57] ABSTRACT

The present invention consists of male and female parts of plane faced segments. A male, square section stem projects perpendicularly from the plane faced segment of the male part. The stem on its free end has a widening in the shape of a hook. The female plane faced segment has a deep cavity such as a runner for inserting the male stem. The cavity extends perpendicularly into the interior of the female plane faced segment with a space congruent with the stem. The cavity has elastically deformable walls and on one of the external walls of the cavity an anchoring opening for the widened end of the male stem of the other plane faced segment.

7 Claims, 7 Drawing Figures

ANCHORING DEVICES FOR JOINING OVERLAPPING CLOTHS FOR GARMENTS OR ARTICLES MANUFACTURED WITH THEM

Anchoring devices for joining overlapping cloths in garments, articles manufactured to be attached to garments, or any manufactures to be attached by fasteners generally include a male part and a female part. The principle objective of the two parts is to structurally cooperate to form a firm, fixed connection that is easy to open and close.

Examples of the typical anchoring device fit into two large groups, i.e.; a group that includes press buttons, and a group that includes hook buttons. In each group, the structural alternatives correspond to the same functional principle.

The present invention is an anchoring device which, like the typical anchoring device, consists of male and female parts. The present invention, however, is superior to the typical device, in that an excellent fixed connection between the male and female parts can be obtained much more easily. So easily, in fact, that the linking or reciprocal maneuver can be performed with only one hand.

Essentially, the present invention consists of male and female parts of plane faced segments. A male, square section stem projects perpendicularly from the plane faced segment of the male part. The stem on its free end has a widening in the shape of a hook. The female plane faced segment has a deep cavity such as a runner for inserting the male stem. The cavity extends perpendicularly into the interior of the female plane faced segment with a space congruent with the stem. The cavity has elastically deformable walls and on one of the external walls of the cavity an anchoring opening for the widened end of the male stem of the other plane faced segment.

BRIEF DESCRIPTION OF THE DRAWINGS

In order that the invention be clearly understood and easily carried out in practice a preferred embodiment is represented in the annexed drawings.

DETAILED DESCRIPTION OF THE INVENTION

Figures 1, 2, 3, 4, 5, 6, 7:
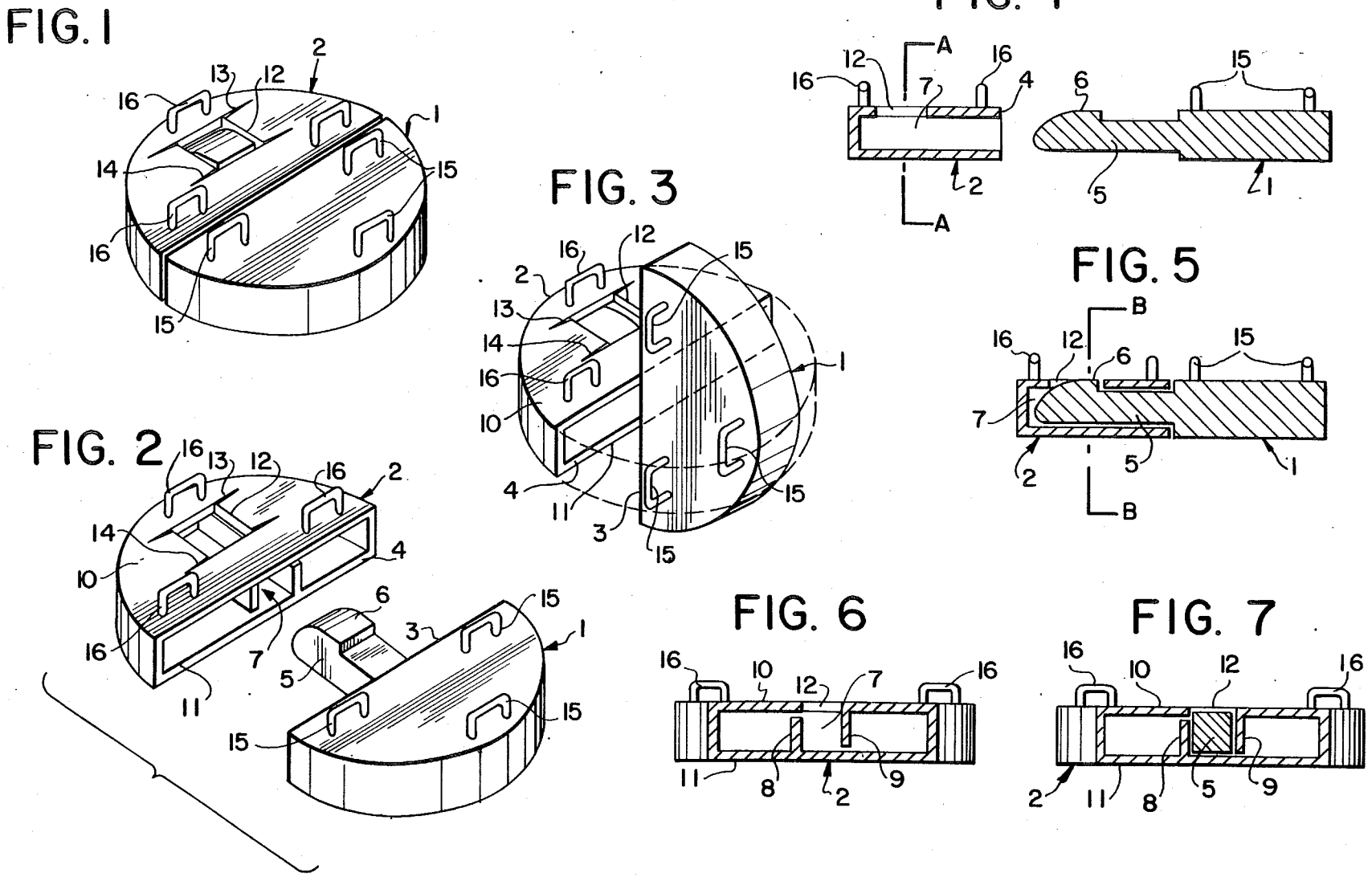
FIG. 1 is a view of the invention in coupled position, showing the front and sides.
FIG. 2 is a view of the component parts of the device shown in FIG. 1, in uncoupled position.
FIG. 3 shows how the parts must be turned in order to be disengaged and uncoupled.
FIG. 4 is a longitudinal view of the female and male parts of the plane faced segments.
FIG. 5 is a longitudinal view of the female and male parts coupled.
FIG. 6 is a cross-sectional view of the uncoupled female plane faced segment (A—A) of FIG. 4.
FIG. 7 is a cross-sectional view of the coupled female plane faced segment (B—B) of FIG. 5.

In all the drawings a male part and a female part are indicated by the numbers 1 and 2 respectively. The male plane face on the male part is represented by the number 3, and the female plane face on the female part is represented by the number 4.

The substantially square male section stem 5 projects perpendicularly from male plane face 3 on male part 1.

The free end of stem 5 forms a widening in the shape of hook 6.

The deepened female cavity 7 for inserting stem 5 extends perpendicularly from female plane face 3 into female part 2. Cavity 7 is substantially square and congruent with stem 5.

Walls 8 and 9 interiorally limit cavity 7. These walls are elastically deformable because each wall is secured to only one of the two walls 10, 11 that is part of female part 2.

On wall 10 of female part 2 is a window 12, which has two opposite transverse edges continued as elastically deformable sections 13 and 14. Sections 13 and 14 constitute an anchor for the widened end 6 of stem 5 when stem 5 is totally inserted in cavity 7 as shown in FIGS. 5 and 7.

In preferred embodiments, both male part 1 and female part 2 are provided with lugs 15, 16 which serve to fasten overlapping cloths for garments or articles that are to be joined.

To join parts 1 and 2, one simply inserts stem 5 into cavity 7 taking care that the widening of end 6 is directed toward window 12 in such a way that when 3 and 4 are in contact with the above mentioned widening, end 6 will stay locked in the window as shown in FIG. 5.

To disengage parts 1 and 2, the two parts are first turned toward each other, as indicated in FIG. 3. This causes walls 8, 9 to elastically deform, permitting the turn. The widening 6 of the end of stem 5 will disengage from window 12, pushing widening 6 toward the outside of cavity 7. Thus, both parts when tractioned, shall disengage.

For both the joining and disengaging of parts 1 and 2, of the invention, the user shall need only one hand. This is so because the speing effect that cavity 7 exercises by its walls 8 and 9 on the inserted stems tends to maintain the stem in a position of release or engagement.

It is understood that the previously described preferred embodiment does not define or limit the invention and that the invention is limited only by the claims appended hereto. It is also understood that modifications can be introduced to the above described embodiment without departing from the scope of the present invention.

I claim:

1. An anchoring device for joining articles comprising a male part and a female part, each having a plane face, wherein the male part further comprises a substantially square cross-section stem extending perpendicularly from the plane face, said stem having a widening in the shape of a hook, and wherein the female part further comprises a tube with an axis perpendicular to the plane face, having a cavity with a square cross-section and extending along said axis in a direction opposite the male part for a distance approximately equal to the length of said stem and adapted to receive said stem, said tube having a pair of parallel elastically deformable walls and a pair of parallel non-deformable walls, one of said non-deformable walls containing an anchoring window which is adapted to receive the widening of the stem and wherein said female part further comprises an exterior casing, said casing being attached to said plane face and said pair of non-deformable walls, and in which said anchoring window is formed by two pairs of opposite transverse edges in one of said non-deformable walls, one pair of said transverse edges being non-deformable and the other pair of edges being elastically deformable, said elastically deformable transverse edges being parallel to the axis of said tube and perpendicular to said place face.

2. An anchoring device according to claim 1 in which each of said elastically deformable walls is secured to only one of said non-deformable walls.

3. An anchoring device according to claim 2 in which said elastically deformable edges have areas of weakness parallel to said plane face of the female part which render said transverse edges elastically deformable.

4. An anchoring device according to claim 3 in which said fastening means are lugs.

5. An anchoring device according to claim 4 in which said elastically deformable transverse edges are formed by cutting slits in said non-deformable walls parallel to the plane face of the female part.

6. An anchoring device according to claim 1 additionally comprising fastening means on each of said male and female parts, said fastening means being suitable for fastening overlapping articles that are to be joined to said male and female parts.

7. An anchoring device according to claim 1 in which said widening of the square cross-section stem is located at the portion of said stem which is distal to the plane face of the male part.

* * * * *